US007578403B2

(12) United States Patent
Tamura et al.

(10) Patent No.: US 7,578,403 B2
(45) Date of Patent: Aug. 25, 2009

(54) ARTIFICIAL NIPPLE FOR A NURSING BOTTLE

(75) Inventors: Yasuo Tamura, Gifu (JP); Kazumi Horie, Chiyoda-ku (JP); Shinya Ishida, Minato-ku (JP)

(73) Assignee: Otsuka Pharmaceutical Co., Ltd., Tokyo-To (JP)

( * ) Notice: Subject to any disclaimer, the term of this patent is extended or adjusted under 35 U.S.C. 154(b) by 0 days.

(21) Appl. No.: 11/635,665

(22) Filed: Dec. 8, 2006

(65) Prior Publication Data

US 2007/0131637 A1 Jun. 14, 2007

(30) Foreign Application Priority Data

Dec. 8, 2005 (JP) ..... 2005-354913

(51) Int. Cl.
*A61J 11/00* (2006.01)

(52) U.S. Cl. ..... 215/11.1; 215/11.4

(58) Field of Classification Search ..... 215/11.1, 215/11.4

See application file for complete search history.

(56) References Cited

U.S. PATENT DOCUMENTS

| | | | | | |
|---|---|---|---|---|---|
| 605,161 | A | * | 6/1898 | Clement et al. | 215/11.1 |
| 705,916 | A | * | 7/1902 | Gauss | 215/11.1 |
| 981,072 | A | * | 1/1911 | Decker | 215/11.1 |
| 1,683,246 | A | * | 9/1928 | Griffiths | 215/11.1 |
| 1,821,913 | A | * | 9/1931 | Smith | 215/11.1 |
| 1,902,433 | A | * | 3/1933 | Brown | 215/11.1 |
| 2,174,361 | A | * | 9/1939 | Condon | 215/11.5 |
| 2,196,870 | A | * | 4/1940 | Little | 215/11.1 |
| 2,227,389 | A | * | 12/1940 | Edwards | 215/11.1 |
| 3,082,770 | A | * | 3/1963 | Straub | 215/11.1 |
| 3,495,993 | A | * | 2/1970 | Barr et al. | 426/117 |
| 3,924,620 | A | * | 12/1975 | Seunevel | 215/11.1 |
| 4,632,263 | A | * | 12/1986 | Gertzman | 215/11.1 |
| 4,834,099 | A | * | 5/1989 | Schrooten | 215/11.1 |
| D360,468 | S | * | 7/1995 | Fuller | D24/196 |

FOREIGN PATENT DOCUMENTS

| | | | |
|---|---|---|---|
| EP | 0 384 394 | A2 | 8/1990 |
| EP | 0496892 | A1 * | 8/1992 |
| JP | 3-176060 | A | 7/1991 |
| JP | 584279 | * | 4/1993 |
| JP | 2000-288 | A | 1/2000 |
| WO | WO 92/03118 | * | 3/1992 |

* cited by examiner

*Primary Examiner*—Sue A Weaver
(74) *Attorney, Agent, or Firm*—Sughrue Mion, PLLC

(57) ABSTRACT

An artificial nipple for a nursing bottle having a nipple top part having at its tip a dispensing hole for dispensing a liquid drink; and an artificial nipple body which is continuous to the nipple top part, and whose diameter and wall thickness are greater than those of the nipple top part. The nipple top part has a rib, which prevents contact between an upper side and a lower side of the nipple top part when the nipple top part is compressed flat, at a portion where gums of an infant touch when an upper lip of the infant is in contact with the artificial nipple body or at an internal surface in the vicinity of the portion.

4 Claims, 7 Drawing Sheets

(a)

(b)

Overlapped view of cross sections taken on line B-B', C-C', and E-E'

(c)

Median section (a)

Outlines of the palates and sucking fossa widths of three groups (b)

Median profile curve between A-CC' of three groups

ARTIFICIAL NIPPLE FOR A NURSING BOTTLE

BACKGROUND OF THE INVENTION

1. Field of the Invention

The invention relates to an artificial nipple for a nursing bottle used for feeding milk to infants.

2. Description of the Related Art

Milk is fed to an infant by the infant's sucking movements, wherein an artificial nipple is squeezed from the bottom to the top by the peristalsis-like movements of the infant's tongue while the nipple is located in the sucking fossa of the infant's upper jaw. The milk is fed when the nipple is in close contact with the infant's sucking fossa.

In view of this fact, Japanese Unexamined Patent Publication No. 2000-288 proposes, to facilitate the sucking movements of infants, an artificial nipple for a nursing bottle that is capable of smoothly inserting the nipple top part inside the sucking fossa by decentering the nipple top part.

However, such an artificial nipple has problems: infants feel discomfort because the artificial nipple is different in shape from a human nipple; and, in many cases, since the nipple top part does not fit the sucking fossa, the nipple is forced into the sucking fossa, resulting in feeding failure. This is because the upper and lower parts of the nipple contact each other and the nipple is compressed flat, resulting in a vacuum in the interior of the nipple.

Japanese Patent No. 2781246 proposes an artificial nipple for a nursing bottle having a check valve for smoothly feeding a liquid drink by peristalsis-like movements. Such an artificial nipple can be formed into a shape similar to a human nipple, and the nipple top part, when made of a material with excellent elasticity, can properly enter the sucking fossa. However, there are some problems in such an artificial nipple, i.e., when the nipple top part is deformed, it inhibits smooth peristalsis-like movements; it is difficult to fit the nipple top part into the sucking fossa of the infant; and due to the slit-shaped valve opening of the check valve, when the valve opening is closed, the interior of the nipple becomes a vacuum, resulting in feeding failure.

BRIEF DESCRIPTION OF SEVERAL VIEWS OF THE DRAWINGS

FIG. 9(*b*) is a view showing overlapping cross sections taken on line B-B', C-C', and E-E'.

FIG. 9(*c*) is a median section.

FIG. 10(*b*) is a median section.

SUMMARY OF THE CERTAIN ASPECTS

Figure 1:
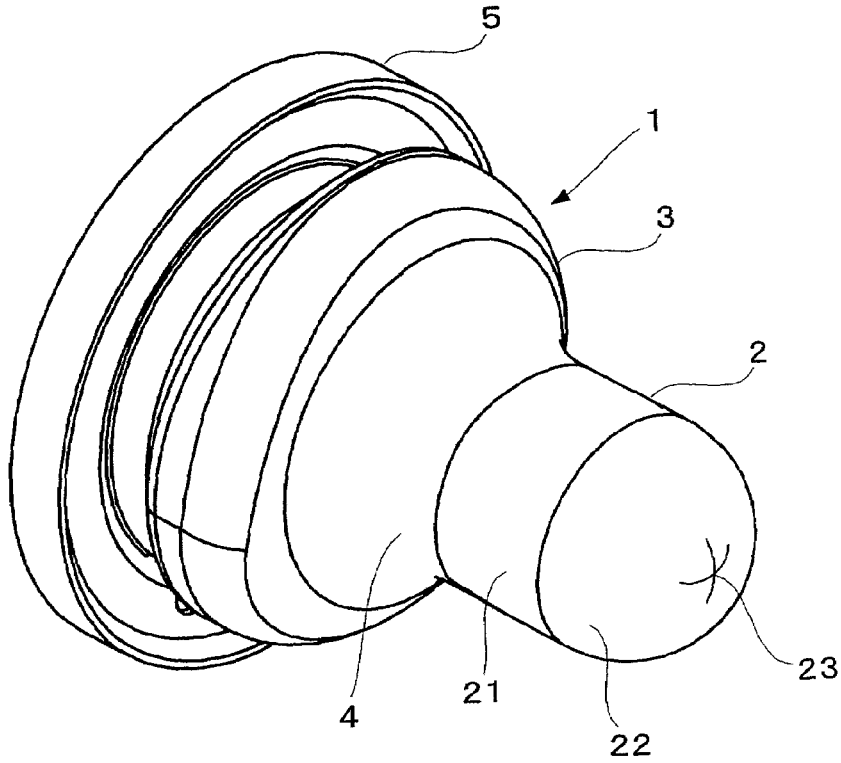
FIG. 1 is a perspective view of an artificial nipple for a nursing bottle according to an embodiment of the present invention.

One embodiment provides an artificial nipple for a nursing bottle which permits close fitting of the nipple to the sucking fossa of an infant while avoiding deformation of the nipple while providing a form that is similar to a human nipple, especially similar to a mother's nipple during the breast feeding period, and which can prevent the upper and lower sides of the nipple from contacting each other during peristalsis-like movements.

An artificial nipple for a nursing bottle according to the embodiment has: a nipple top part having at its tip a dispensing hole for dispensing a liquid drink; and an artificial nipple body which is continuous to the nipple top part, and whose diameter and wall thickness are greater than those of the nipple top part. The artificial nipple is made of a flexible material. The nipple top part has a rib, which prevents contact between an upper side and a lower side of the nipple top part when the nipple top part is compressed flat, at an internal surface of a portion where gums of an infant touch when an upper lip of the infant is in contact with the artificial nipple body or at an internal surface in the vicinity of the portion.

In one embodiment, the rib is formed along the internal surface of the nipple top part along a circumferential direction so that an oval opening surrounded by the rib is formed.

In one embodiment, the artificial nipple body has an expanded part for ensuring a suitable depth in which the nipple top part enters a mouth of an infant when an upper lip of the infant touches the expanded part.

In one embodiment, a thickness of an upper side of the artificial nipple body is greater than that of a lower side thereof.

In one embodiment, upper and lower sides of the nipple top part are thinner than left and right sides thereof between the rib and a root of the nipple top part.

According to one embodiment, the artificial nipple for a nursing bottle has a nipple top part and an artificial nipple body which is continuous to the nipple top part and whose diameter and wall thickness are greater than those of the nipple top part. The artificial nipple is made of a flexible material. The nipple top part has a rib, which prevents contact between the upper side and the lower side of the nipple top part when the nipple top part is compressed flat, at an internal surface of a portion where the gums of an infant touch when the upper lip of the infant is in contact with the artificial nipple body or at an internal surface in the vicinity of the portion. The rib increases the rigidity of the nipple top part at the portion where the rib is formed. Thus, the nipple top part is smoothly deformed at the boundary between the rib and the body by the pressure of the infant's tongue applied to the nipple top part while milk feeding. The nipple top part can therefore enter the sucking fossa without deformation of the nipple top part, to enable smooth peristalsis-like movement.

A recent investigation shows that the width and depth of the sucking fossa of infants do not change with growth. Therefore, when the artificial nipple is configured in such a manner that the nipple top part bends without failure at the boundary and enters the sucking fossa, infants can be optimally milk fed simply by adjusting the size of the nipple top part according to the sucking fossa.

Moreover, the rib functions as a spacer between the upper and lower sides of the nipple top part and can prevent the upper and lower sides of the nipple top part from contacting each other, to prevent a vacuum from forming in the nipple top part during the peristalsis-like movement. Therefore, even when the artificial nipple is formed into a shape similar to a human nipple, milk feeding can be stably performed.

When the rib is provided along the circumferential direction of the internal surface of the nipple top part, an oval opening is formed so as to be surrounded by the rib. Thus, the rigidity of the nipple top part at the portion where the rib is formed extends over the entire circumference of the nipple top part. The above-described effect can therefore be further assured.

If the upper side of the body has an expanded part to ensure proper insertion depth when the nipple top part enters the mouth of the infant due to the upper lip of the infant contacting the expanded part, the nipple top part can be precisely located in the sucking fossa of the infant.

When the thickness of the upper side of the body is greater than that of the lower side thereof, the lower side of the body extends more easily than the upper side thereof, which makes it possible for the nipple top part to easily turn upward. When the thickness of the upper and lower sides of the nipple top part is less than that of the right and left sides thereof between the rib and the root of the nipple top part, the nipple top part can turn upward while being supported at the right and left sides, which can prevent the nipple top part from adversely turning sideways. As a result, the nipple top part can precisely enter the sucking fossa.

DESCRIPTION OF CERTAIN INVENTIVE EMBODIMENT

Figure 2:
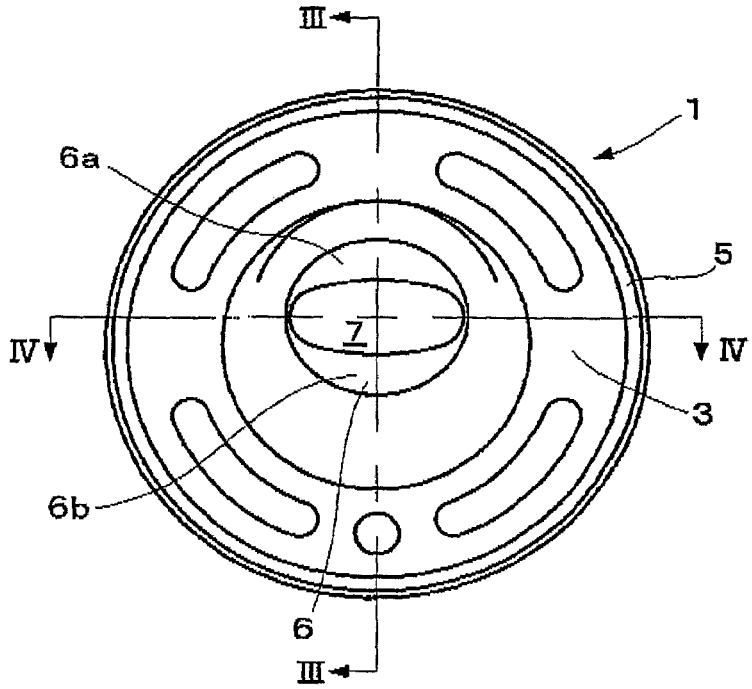
FIG. 2 is a rear view of the artificial nipple for a nursing bottle according to the embodiment.
Figure 3:
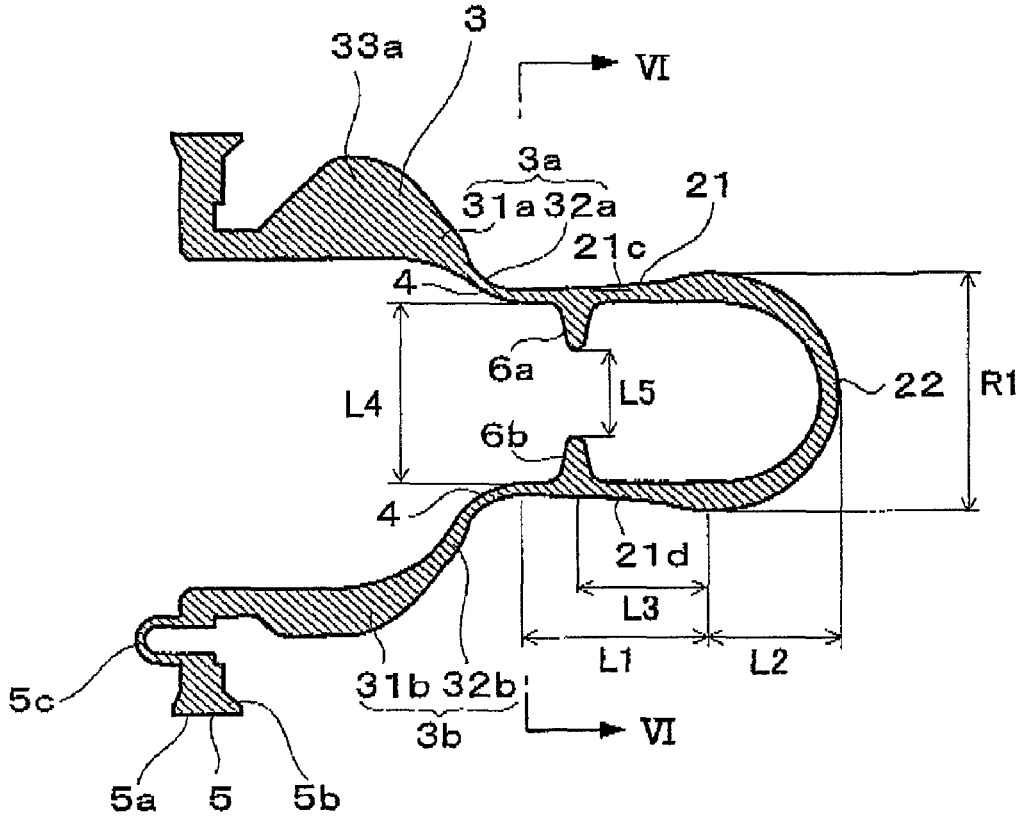
FIG.3 is a longitudinal section taken on line III-III of FIG.2.
Figure 4:
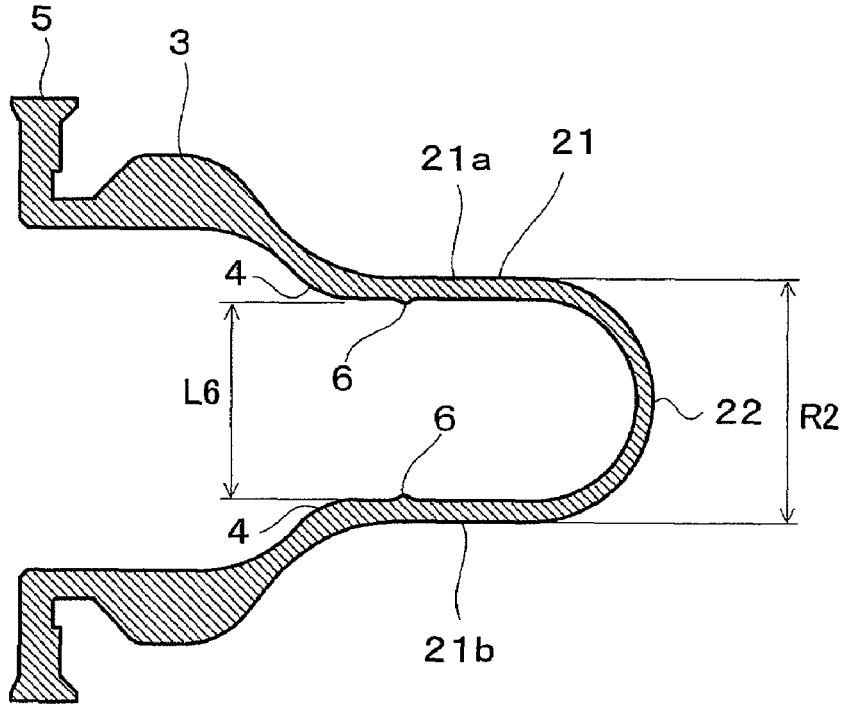
FIG. 4 is a longitudinal section taken on line IV-IV of FIG.2.
Figure 5:
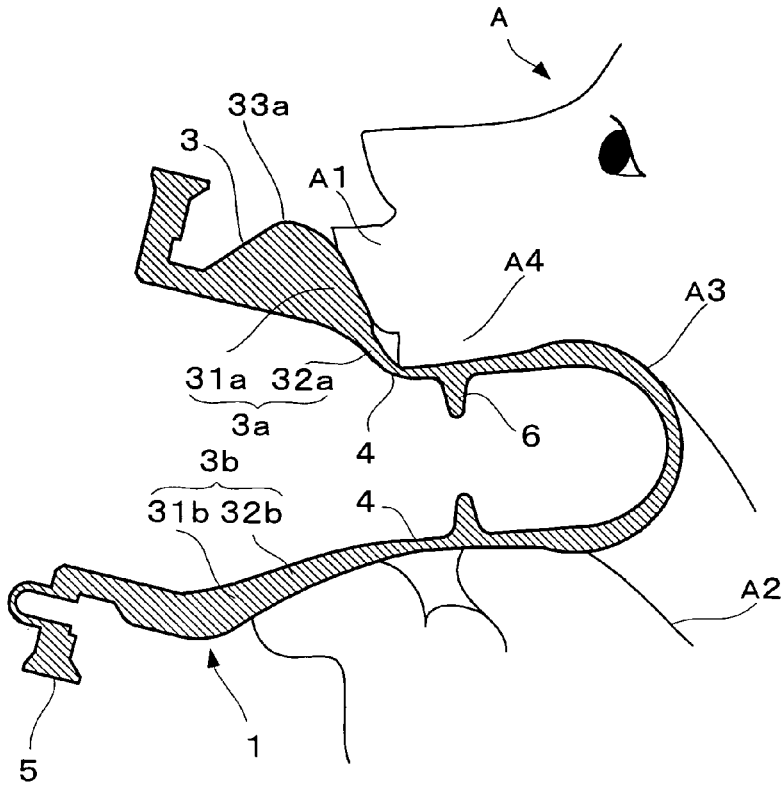
FIG. 5 is a longitudinal section showing use of the artificial nipple for a nursing bottle according to the embodiment.

Hereinafter, the artificial nipple for a nursing bottle is described according to one embodiment with reference to drawings. FIG. 1 is a perspective view of an artificial nipple 1 for a nursing bottle according to an embodiment of the present invention. FIG. 2 is a rear view of the artificial nipple 1 for a nursing bottle according to the embodiment. FIG. 3 is a longitudinal section taken on line III-III of FIG. 2. FIG. 4 is a longitudinal section taken on line IV-IV of FIG. 2. FIG. 5 shows usage of the artificial nipple 1 for a nursing bottle according to the embodiment.

The artificial nipple 1 for a nursing bottle is formed by molding, such as injection molding, a rubber material, such as silicone rubber, polyurethane rubber, and the like. The artificial nipple 1 comprises a nipple top part 2, a bowl-like body 3 which is continuous to the nipple top part 2, a boundary part 4 between the nipple top part 2 and the body 3, and an attachment part 5 formed in the periphery of the body 3.

The nipple top part 2 has a nipple top part body 21 connected to the body 3 and a dome part 22 at the tip of the nipple top part body 21. The dome part 22 has a milk-dispensing hole 23 at the top. The milk-dispensing hole 23 is formed by making an X-shaped cut in the top of the dome part 22.

The nipple top part 2 comprises a rib 6 formed along the entire circumferential direction (i.e., the direction across the nipple top part 2) of the internal wall. This rib 6 is used to form an oval opening 7. The rib 6 is formed at an internal surface of a portion where the gums A4 of an infant touch when the upper lip A1 of the infant is in contact with the body 3, or at an internal surface in the vicinity of that portion. In one embodiment, the rib 6 is located at a portion apart from the edge of the expanded part 33*a* (described later) by a predetermined interval in such a manner that the gums A4 of an infant A can be located near the edge of the expanded part 33*a* of the body 3 between the rib 6 and the edge of the expanded part 33*a* while the upper lip A1 of the infant A is in contact with the expanded part 33*a*.

In one embodiment, the thickness over the entire length of the right and left sides 21*a* and 21*b* of the nipple top part body 21 of the nipple top part 2 is made to be the same. The thickness of the upper and lower parts 21*c* and 21*d* are made to increase gradually toward the top of the nipple top part 21.

In one embodiment of the nipple top part body 21, the thickness of the right and left sides 21*a* and 21*b* of the nipple top part body 21 is larger than the thickness of the lower and upper sides 21*c* and 21*d* thereof between the rib 6 and the root of the nipple top part body 21. The nipple top part 2 can turn upward while being supported by the right and left sides 21*a* and 21*b* of the nipple top part body 21, which can prevent the nipple top part 2 from turning sideways in an infant's mouth.

Figure 8:
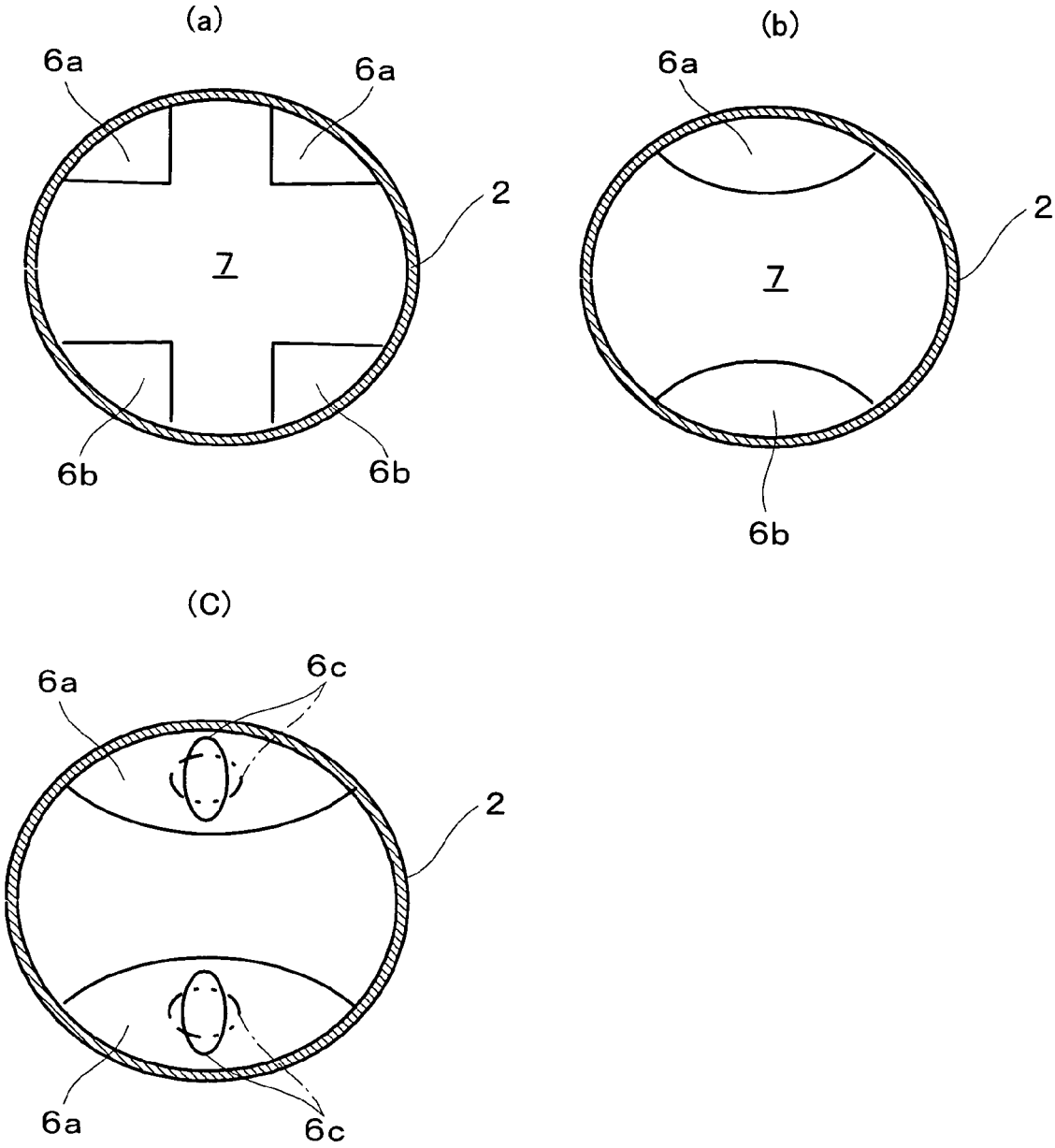
FIGS. 8(*a*), (*b*), and (*c*) are views of a rib of the artificial nipple for a nursing bottle according to the embodiment.

The shape of the rib 6 is not limited to the above and the rib 6 can also be formed as shown in FIG. 8. FIG. 8(*a*) shows a shape wherein the rib 6 does not cover the central axis so that a liquid drink can flow through the central part of the nipple top part 2 even when the nipple top part 2 is compressed flat. FIG. 8 (*b*) shows that the central part of the rib 6 is swelled so as not to extend to both sides, thereby preventing the channeling area for a liquid drink from being narrowed. FIG. 8 (*c*) shows that lengthwise pores 6*c* are formed in the rib 6 so that the pores 6*c* can extend as shown by the chain double-dashed lines, thereby ensuring a channeling area for a liquid drink.

For the body 3, the thickness of the upper side 3*a* of the body 3 is greater than that of the lower side 3*b* of the body 3 due to the expanded portion 33*a*. As shown in FIG. 3, a long inclined part 32*b* whose thickness is substantially the same as that of the boundary part 4 is connected to a horizontal part 31*b* of the lower side 3*b* of the body 3, and the terminal end of the inclined part 32*b* is connected to the boundary part 4. A short inclined part 32*a* whose thickness is substantially the same as that of the boundary part 4 is connected to a horizontal part 31*a* of the upper side 3*a* of the body 3, and the terminal end of the inclined part 32*a* is connected to the boundary part 4. As shown in FIG. 3, the depth of the lower side 3*b* of the body 3 is greater than that of the upper side 3*a* of the body 3, which allows infants to securely hold the artificial nipple in the mouth.

The attachment part 5 has a flange 5*a* formed at the periphery of the body 3, a rim 5*b* formed at the under surface of the flange 5*a*, and an air valve 5*c* provided in a part of the flange 5*a*. The air valve 5*c* at the bottom surface of the flange 5*a* has a bag-like form and a slit (not shown).

The artificial nipple 1 can be extended flat like a mother's nipple, and the extension of the artificial nipple 1 is assisted by the entire body 3, including the upper side 3*a* of the body 3.

The use and actions of the artificial nipple 1 configured as described above will be described next.

First, to attach the artificial nipple 1 to a nursing bottle, the attachment part 5 is inserted into the opening of the nursing bottle and then the flange 5*a* is fixed between the nursing bottle and its cap.

Subsequently, the artificial nipple 1 is placed in the mouth of the infant A, and milk is fed to the infant while the bottom of the nursing bottle is kept higher than the artificial nipple 1.

The positioning of the nipple top part 2 is performed when the upper lip A1 of the infant contacts the inclined part of the expanded part 33*a* of the body 3, thereby inserting the nipple top part 2 into the mouth of the infant A to a proper depth. When the infant A slightly pushes up the nipple part 2 with the tongue A2 in this state, a part of the nipple top part body 21 between the rib 6 and the root of the nipple top part body 21 and the boundary part 4 deform smoothly. This allows the nipple top part 2 to enter the sucking fossa A3 without warp, and enables smooth peristalsis-like movement. Moreover, since the upper side 3*b* of the body 3 is extended more easily than the upper side 3*a* of the body 3 due to the difference in thickness, the nipple top part 2 easily turns upward to fit the sucking fossa of the infant A.

Figure 6:
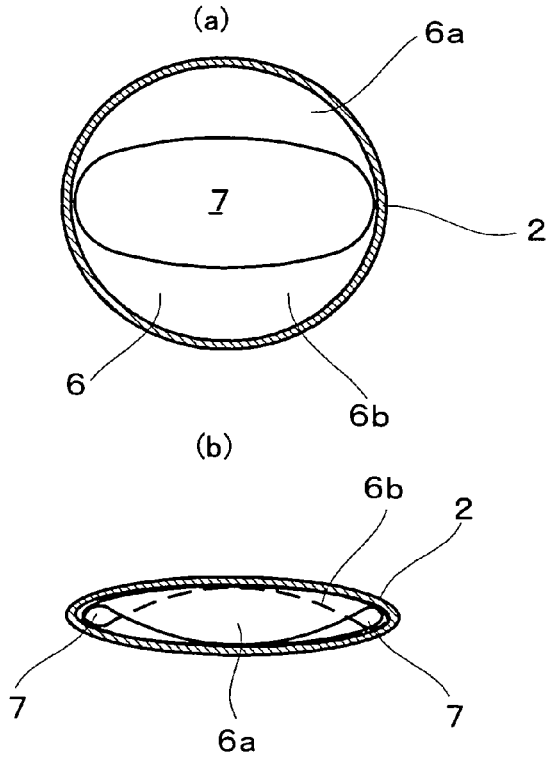
FIGS. 6(*a*) and 6(*b*) are longitudinal sections of non-compressed and compressed states of the nipple top part taken on line VI-VI of FIG. 3.
Figure 7:
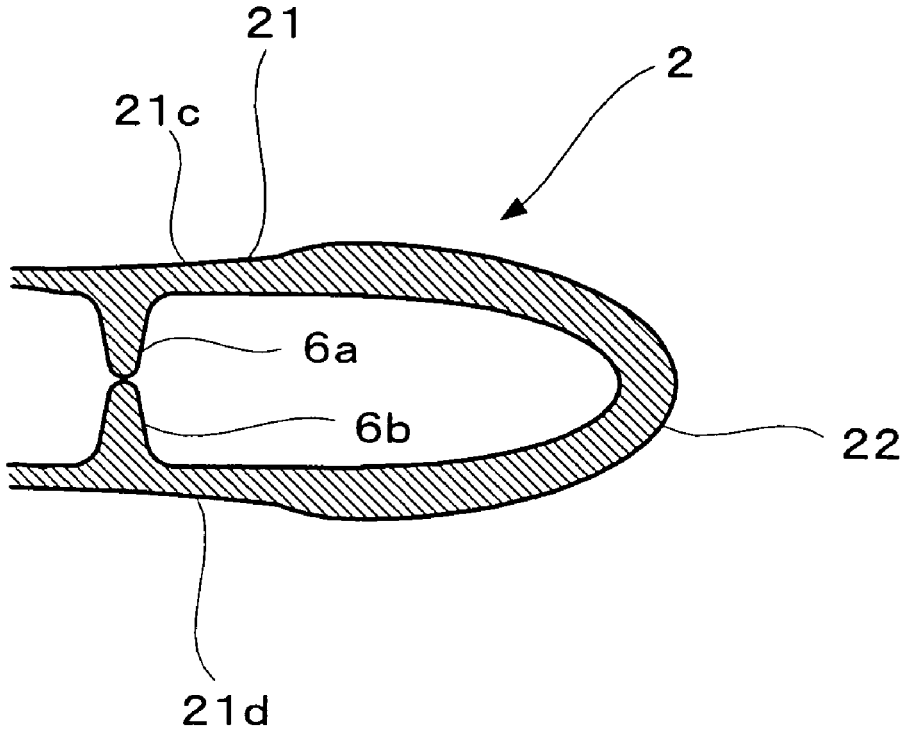
FIG. 7 is a cross section showing that the nipple top part of the artificial nipple for a nursing bottle according to the embodiment is compressed flat.

FIG. 6(*a*) depicts the nipple top part 2 in a non-compressed state. When the nipple top part 2 is compressed flat, however, as shown in FIGS. 6(*b*) and 7 with the peristalsis-like movement of the tongue A2 of the infant A, the rib 6 can prevent the upper and lower sides of the nipple top part 2 from contacting each other. This prevents disruption of the liquid drink introduced into the nipple top part 1 in the body 3 due to the interruption of the flow thereof. Therefore, the liquid drink is smoothly fed to the infant A through the milk dispensing hole 23. The upper and lower sides 6*a* and 6*b* of the rib 6 do not need to engage as shown in FIG. 6 (*b*), but may engage as shown in FIG. 7.

The form and dimensions of the above-described artificial nipple are determined based on the measurement results of infant palates. Infants were classified into three groups of infants aged one to two months, infants aged three to four months, and infants aged five months or above, and were measured.

Figure 9:
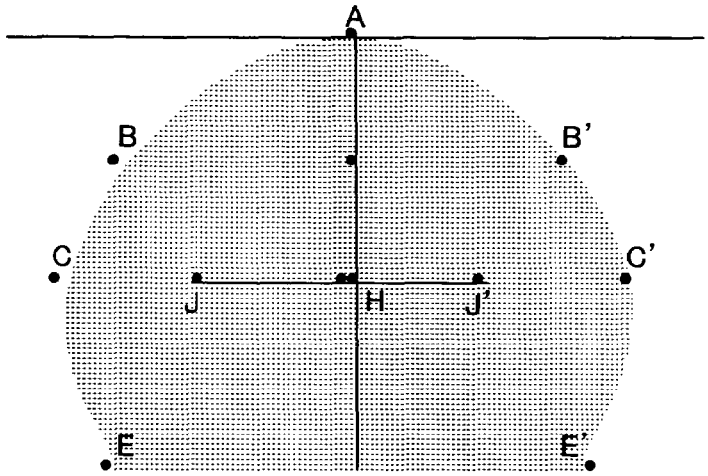
FIG. 9(*a*) is a plan view showing the palate of an infant.
Figure 9:
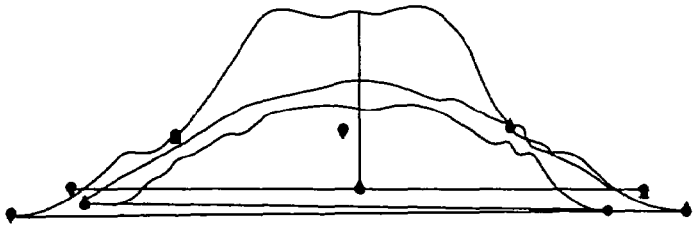
Figure 9:
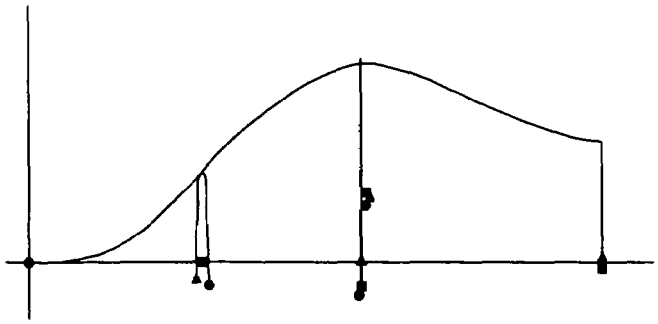

FIG. 9(*a*) is a plan view showing the palate of an infant. The palate-measuring reference points are shown in FIG. 9(*a*) as follows: point A on the top of the alveolar crest of the papilla incisive part; tops B and B' of the lateral sulcus of a distal wall of the alveolar lateral sulcus of the upper primary canine; points C and C' at the top of the alveolar crest, which refers to the maximum breadth of the alveolar arch; and points E and E' of the most distal end of the alveolar, corresponding to the tuber maxillae. The plane made from the three points of A, E, and E' was defined as a reference plane. Measurements were also performed at point F which is the intersection of the line E-E' and the vertical extension line starting from point A as a reference point and the inflection points J and J' extending from the subalveolar ridge in the palate median direction on the C-C' section. Based on these reference points and measurement items, the major axis and width diameter between each measurement point, and the regression curve in the median section and horizontal cross section were measured. The form of the artificial nipple was determined by referring to the average sucking fossawidth, distance to the palate's deepest part, the movements of the jaw during sucking, etc. FIG. 9(*b*) is a view showing that cross sections C, D, and E are overlapped. FIG. 9(*c*) is a median section.

Figure 10:
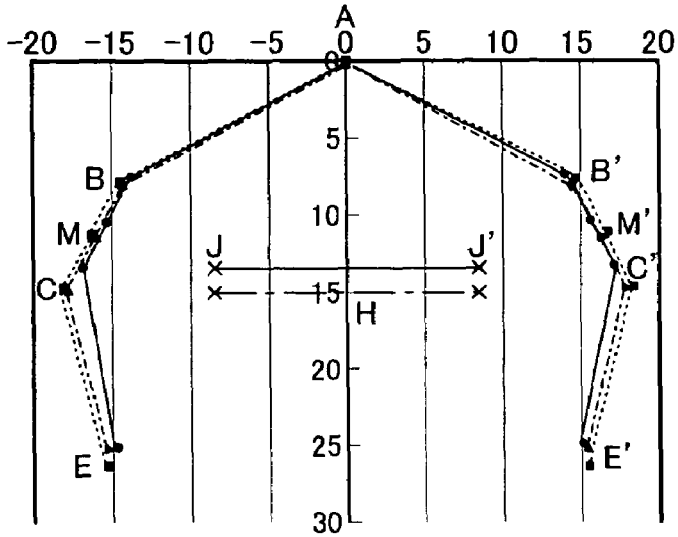
FIG. 10(*a*) shows outlines of the palates of a group of infants aged one to two months, a group of infants aged three to four months, and a group of infants aged five months or above.
Figure 10:
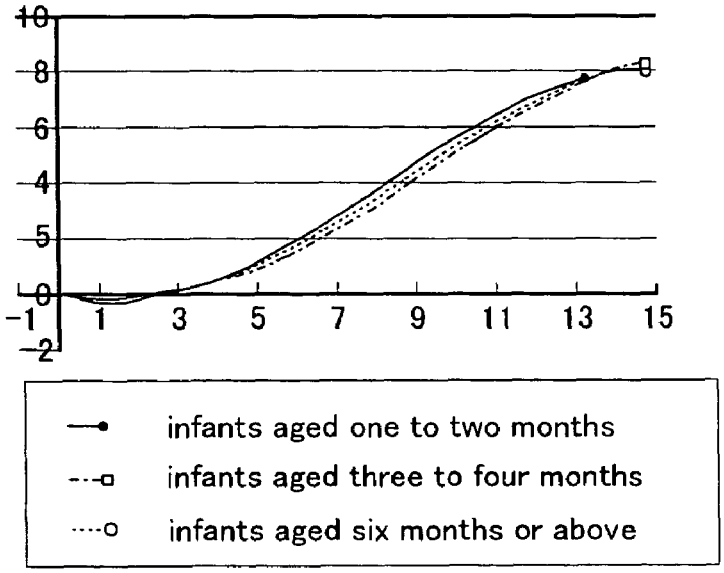

FIG. 10 (*a*) shows an outline of the palate based on the measurement results of the three groups, and FIG. 10(*b*) shows a median profile curve. For the palate major axis, when a group of infants aged one to two months is used, A-CC' significantly increased, while A-BB' and A-EE' showed no change. For the palate width diameter, BB', CC', and MM' significantly increased, while EE' and JJ' showed no change. It was found that the palate depth hardly changed with growth. The horizontal distance from the fasset forefront side to the deepest point is 16.1 mm (average) for infants aged one to two months, 16.5 mm (average) for infants aged three to four months, and 17.00 mm (average) for infants aged five months or above. No significant difference between groups was observed. The average horizontal distance of all of the infants was 16.6 mm. No difference was observed in the sucking fossa between groups and the average of 39 infants was 16.9 mm. Although there was hardly any difference observed in the ratio of each muscle activity relative to the total muscle activity compared with a group of breastfeeding infants, there was a tendency for the total muscle activity to be small.

The dimensions of an artificial nipple were determined as follows based on the above results. More specifically, the dimensions of the nipple top part 2 in the cross section were determined as follows: the maximum outer diameter R1 was 15 mm: the distance L1 from the root of the nipple top part 2 to the maximum outer-diameter part was 16 mm; the distance L2 from the tip of the nipple top part 2 to the maximum outer-diameter part was 7.5 mm; the distance L3 from the part where the rib 6 was formed to the maximum outer-diameter part was 8 mm; the inner diameter L4 of the root was 13 mm; and the distance from the upper side 6*a* and lower side 6*b* of the rib 6 was 5 mm (FIG. 3).

The dimensions of the nipple top part 2 in the longitudinal section were determined as follows: the outer diameter R2 was 15 mm, which was the same over the entire length of the nipple top part 2, and the inner diameter L6 of the root of the nipple top part 2 was 12.4 mm (FIG. 4).

Twenty subjects were monitored while using an artificial nipple having the above-described dimensions. Twelve subjects became accustomed to the nipple immediately; twelve subjects apparently drank easily; eleven subjects drank rhythmically; thirteen subjects spilled less than before; six subjects drank more, and 4 subjects burped less. Overall, twenty subjects showed favorable change.

The invention claimed is:

1. An artificial nipple for a nursing bottle comprising:

a nipple top part having at its tip a dispensing hole for dispensing a liquid drink; and an artificial nipple body which is continuous to the nipple top part, and whose diameter and wall thickness are greater than those of the nipple top part, the artificial nipple being made of a flexible material, the nipple top part having a rib, which prevents contact between an upper side and a lower side of the nipple top part when the nipple top part is compressed flat, at an internal surface of a portion where gums of an infant touch when an upper lip of the infant is in contact with the artificial nipple body or at an internal surface in the vicinity of the portion, the rib being formed along the internal surface of the nipple top part along a circumferential direction so that an oval opening surrounded by the rib is formed, wherein side portions of the oval opening remain open when the nipple top part is compressed.

2. The artificial nipple for a nursing bottle according to claim 1, wherein the artificial nipple body has an expanded part for ensuring a suitable depth in which the nipple top part enters a mouth of an infant when an upper lip of the infant touches the expanded part.

3. The artificial nipple for a nursing bottle according to claim 1, wherein a thickness of an upper side of the artificial nipple body is greater than that of a lower side thereof.

4. The artificial nipple for a nursing bottle according to claim 1, wherein upper and lower sides of the nipple top part are thinner than left and right sides thereof between the rib and a root of the nipple top part.

* * * * *